US011274545B2

(12) United States Patent
Klein

(10) Patent No.: US 11,274,545 B2
(45) Date of Patent: Mar. 15, 2022

(54) DEVICE FOR THE POSITIONING OF AN ELECTRONIC UNIT ON A GROUND DRILLING DEVICE

(71) Applicant: TRACTO-TECHNIK GMBH & CO. KG, Lennestadt (DE)

(72) Inventor: Tobias Klein, Lennestadt (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 0 days.

(21) Appl. No.: 16/539,158

(22) Filed: Aug. 13, 2019

(65) Prior Publication Data

US 2020/0056474 A1 Feb. 20, 2020

(30) Foreign Application Priority Data

Aug. 16, 2018 (DE) ..... 102018006464

(51) Int. Cl.
*E21B 47/09* (2012.01)
*E21B 47/04* (2012.01)
*E21B 47/024* (2006.01)

(52) U.S. Cl.
CPC ..... *E21B 47/09* (2013.01); *E21B 47/024* (2013.01); *E21B 47/04* (2013.01)

(58) Field of Classification Search
CPC ..... E21B 47/09; E21B 47/024; E21B 47/04
See application file for complete search history.

(56) References Cited

U.S. PATENT DOCUMENTS

| | | | | |
|---|---|---|---|---|
| 3,604,121 | A | 9/1971 | Hull | |
| 3,832,782 | A | 9/1974 | Johnson et al. | |
| 6,049,378 | A | 4/2000 | Busch et al. | |
| 6,195,615 | B1 * | 2/2001 | Lysen | G01B 11/27 33/281 |
| 6,591,218 | B1 * | 7/2003 | Lysen | G01B 11/26 33/281 |
| 6,966,120 | B2 | 11/2005 | Lysen | |
| 6,981,333 | B2 | 1/2006 | Busch | |
| 8,997,891 | B2 * | 4/2015 | Schauerte | E21B 7/046 175/57 |
| 2001/0020335 | A1 * | 9/2001 | Busch | G01B 21/24 33/645 |
| 2004/0139621 | A1 * | 7/2004 | Lysen | G01B 21/24 33/412 |
| 2005/0173153 | A1 * | 8/2005 | Alft | E21B 7/046 175/46 |

(Continued)

FOREIGN PATENT DOCUMENTS

| | | | |
|---|---|---|---|
| DE | 19733919 | A1 | 2/1999 |
| DE | 19949834 | A1 | 4/2001 |
| DE | 10051870 | A1 | 7/2001 |

*Primary Examiner* — Taras P Bemko
(74) *Attorney, Agent, or Firm* — Howard IP Law Group, P.C.

(57) ABSTRACT

A device for the positioning of an electronic unit on a front-end section of a drill string of a ground drilling device includes a seat and a bearing surface. The electronic unit is designed to determine at least one of location, height, position and direction. The seat is configured for mounting or placement of the electronic unit onto the device. The bearing surface is adapted to be mounted to, or placed on, the outer contour of the front-end section to provide a predetermined positioning or reference between the seat and the front-end section of the drill string.

17 Claims, 1 Drawing Sheet

(56) References Cited

U.S. PATENT DOCUMENTS

| | | | | |
|---|---|---|---|---|
| 2012/0168230 | A1* | 7/2012 | Goeke | E21B 7/067<br>175/325.1 |
| 2017/0226805 | A1* | 8/2017 | Cole | E21B 47/0232 |
| 2017/0248000 | A1* | 8/2017 | Hundt | G06F 17/40 |
| 2017/0292335 | A1* | 10/2017 | Schumacher | E21B 17/06 |

* cited by examiner

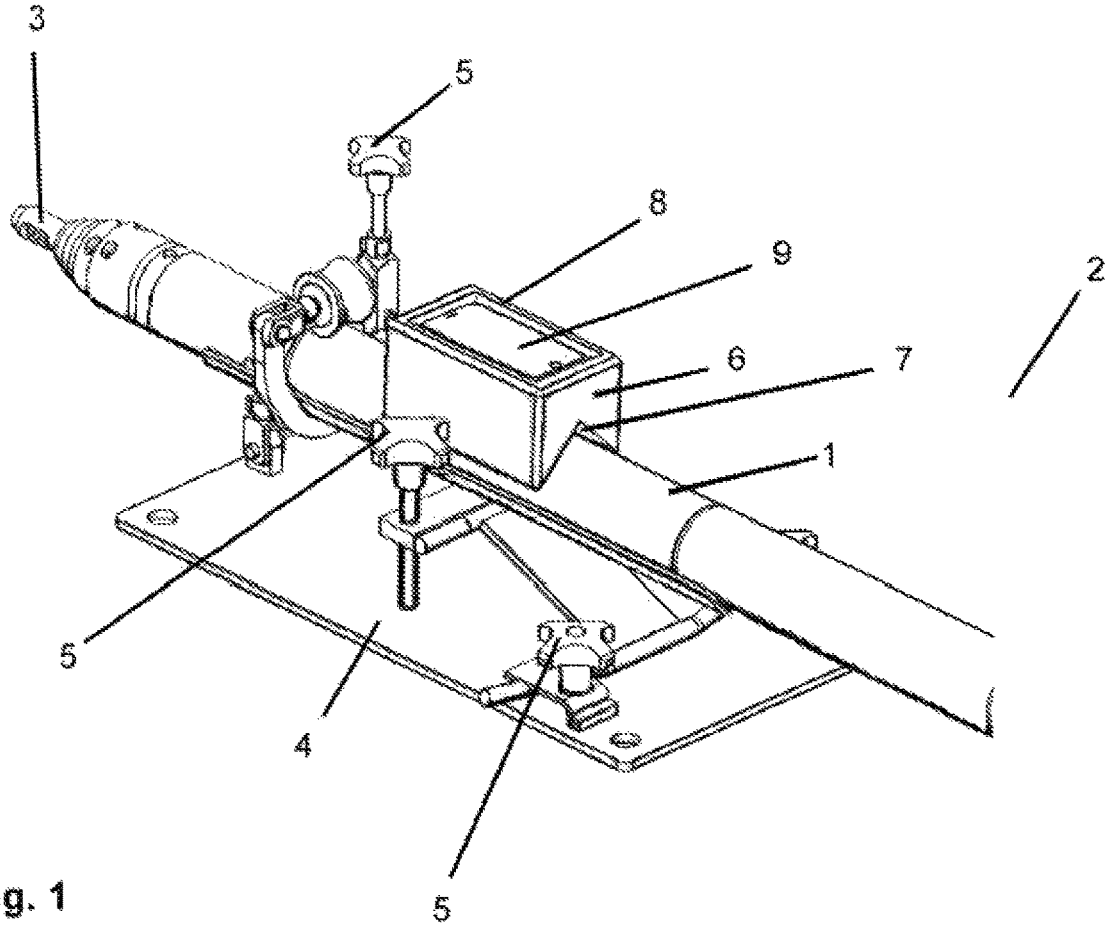
Fig. 1
Fig. 2
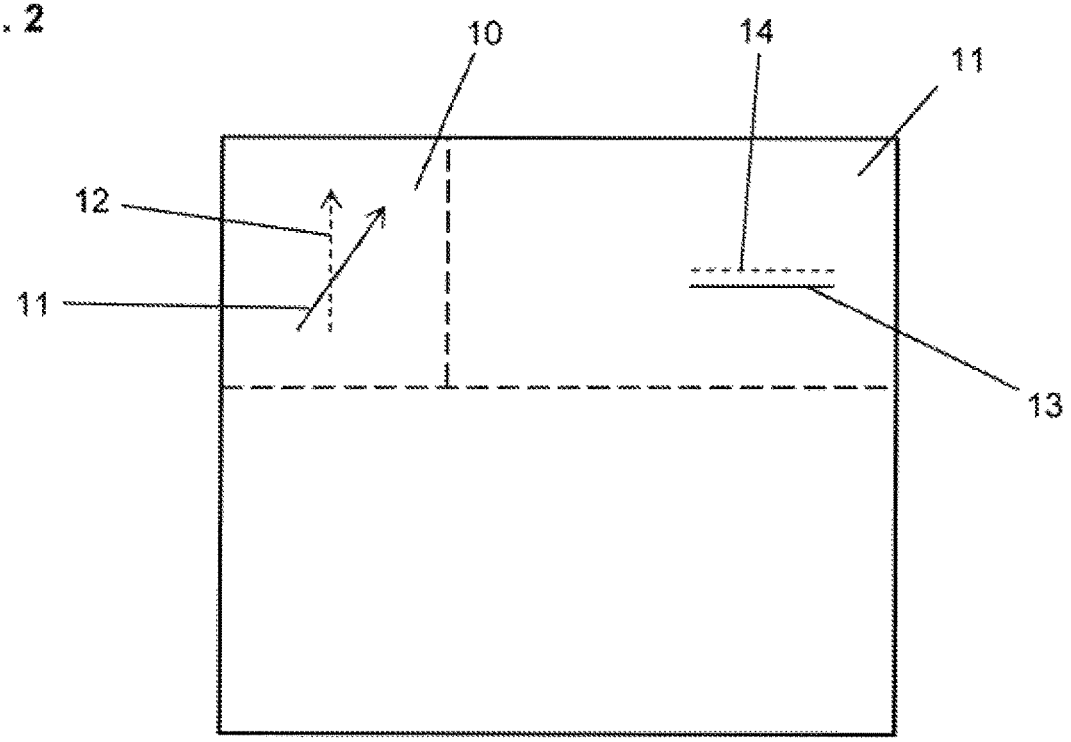

DEVICE FOR THE POSITIONING OF AN ELECTRONIC UNIT ON A GROUND DRILLING DEVICE

FIELD OF INVENTION

The invention relates to a device for positioning an electronic unit on a front-end section of a drill string of a ground drilling device, a system for orienting a front-end section of a drill string, a method for orienting a front-end section of a drill string of a ground drilling device and a use of an electronic unit for orienting a front-end section of a drill string.

BACKGROUND

In ground drilling devices it is known how to use a telescopic target rod with targeting optics on the drilling head in order to take a bearing on the target and orient the drilling head appropriately. Although the use of a sounding rod with sounding optics is a good and satisfactory solution, carrying along such equipment is expensive and the operating of the sounding optics requires some training.

SUMMARY

One problem which the invention proposes to solve is to provide a device, a system, a method and a use enabling an easier positioning of a front-end section of a drill string of a ground drilling device.

The invention starts from the basic idea of positioning an electronic unit on a front-end section of a drill string of a ground drilling device in order to orient the front-end section of the drill string and thus the drill string of the ground drilling device. The target position, especially in a target pit, which is to be reached with the ground drilling device, may be known, and the target position may be entered into the electronic unit. The electronic unit may calculate a relative position to the target position by determining at least one of the parameters: location, height, position and orientation, and based on a fixed relationship of the electronic unit and the front-end section of the drill string of the ground drilling device the front-end section can be oriented with the electronic unit in order to reach the target position. It is possible to mount an electronic unit without major expense in a predetermined manner on the drill string and to perform an orientation in accordance with a display of the electronic unit.

The invention creates a device for the positioning of an electronic unit on a front-end section of a drill string of a ground drilling device, wherein the electronic unit is designed to determine at least one of the following pieces of information: location, height, position and direction. The device has a seat for the electronic unit and a bearing surface adapted to the outer contour of the front-end section.

In the sense of the specification, the term "positioning" encompasses a mounting of the electronic unit in a predetermined manner relative to the drill string by means of the device, wherein in particular the distance, the position and the direction of the electronic unit relative to the front-end section is given. It may be provided that the location is not fixed in relation to the longitudinal axis of the drill string, and accordingly the device may be displaceable with respect to the drill string on the front-end section. But it may also be provided that the device for the positioning of the electronic unit orients the unit in a predetermined location, a predetermined distance, a predetermined position and a predetermined direction with respect to the drill string, especially to the front-end section of the drill string.

The term "electronic unit" in the sense of the specification encompasses an electronic device comprising an indication for the orienting of the front-end section of the drill string. The indication may be visual in particular, in the form of an optical indication, display, LCDs, VFDs or other optical reading means. The indication may also be designed as an acoustical indication, providing an acoustical signal which is characteristic of the correct or substantially correct orientation of the drill string. For example, the acoustical signal may put out a sequence of tones, whose speed or frequency increases when the drilling head is shifted or changed to a position of a desired orientation. The electronic unit is designed to determine at least one of the following pieces of information: location, height, position and direction of the electronic unit. The electronic unit may be a mobile telephone, a tablet or a smartphone, so that it is possible to use an electronic unit which is normally carried along by the user in order to orient a front-end section of a drill string. A significant added value can be achieved merely by installing software which can be executed in the electronic unit, especially an application software or mobile app, on the electronic unit. The app can make possible the entry of a target position, and the parameters ascertained by the electronic unit can be used for an orientation relative to the electronic unit. The term "electronic unit" is not confined here solely to a physical unit, but also encompasses the option that the power supply, for example, in the form of a battery or power supply cables, is situated outside the electronic unit.

The term "entry" in the sense of the invention includes the possibility of entering the target position by hand on the electronic unit and/or relaying the target position to the electronic unit by wireline or wireless manner. In particular, a further electronic unit, especially a further mobile telephone, a tablet or a smartphone may relay the target position wirelessly to the electronic unit. For this, the further electronic unit may be brought to the target position and a determination of the target position can be carried out by the further electronic unit.

The term "ground drilling device" in the sense of the specification encompasses any device which moves a drill string, with which a conduit or a pipe or a borehole can be introduced into the earth.

The term "soil" in the sense of the present specification encompasses in particular every kind of existing or yet to be produced channels or boreholes, preferably horizontal channels in a body, especially earth channels, including earth boreholes, rock boreholes, or earth conduits, as well as underground or aboveground pipelines and water canals which can be produced or pulled in by the use of a corresponding ground drilling device.

The ground drilling device may be a displacement hammer, a percussion drilling device, or such like. By "percussion drilling device" in the sense of the specification is meant in particular any apparatus which is moved intermittently in an existing canal or one being produced in order to create or widen a borehole or to replace or clean an existing pipe in destructive or nondestructive manner, to pull conduits into existing pipes, and all construction apparatus for underground tunneling. In particular, a percussion drilling device may be a self-propelled impact device for creating a horizontal borehole. The ground drilling device may be a ground drilling device working by displacement, clearing, and/or flushing to produce a horizontal borehole.

The term "horizontal drilling" in the sense of the specification encompasses in particular every type of existing or yet to be produced channels, preferably horizontal channels in a body, especially earth channels, including earth boreholes, rock boreholes, or earth conduits, as well as underground or aboveground pipelines and drainage canals which can be produced, widened, destroyed, cut open or cleaned by the use of a corresponding soil displacing ground drilling device.

The term "seat" encompasses in the sense of the specification the possibility that the electronic unit can be lying on the device or mounted on the device. The seat may be adapted to the electronic unit, and the "adapting" can be achieved in that a seat can be chosen at will for a particular configuration of the electronic unit and the electronic unit can be laid on or mounted in the seat. In addition or alternatively, it may be provided that the seat can be adapted in modular fashion to the electronic unit or its outer dimensions. An "adaptable seat" thus produces first of all a predetermined positioning or reference as to how the electronic unit is situated relative to the seat. In particular, the adapting can make possible a definite position of the electronic unit with respect to the longitudinal axis of the front-end section of the drill string.

The term "adapted bearing surface" in the sense of the specification encompasses an adapted geometry or structure optionally at the front-end section of a drill string of a ground drilling device in order to create a predetermined positioning or reference between the seat and the front-end section of the drill string. An "adapting" can be accomplished in that a predetermined relative position and/or orientation is achieved by means of the bearing surface on the front-end section of the drill string relative to this.

By means of the seat and the adapted bearing surface, a predetermined positioning of the device relative to the front-end section of the drill string and thus a predetermined arrangement of the unit relative to the front-end section of the drill string can be achieved. The device produces by mechanical means a fixed relationship between the front-end section of the drill string and the electronic unit, including in particular the parameters of distance, position and direction. If the location, the position in space, the orientation and the height of the electronic unit are known, then because of the fixed relationship produced by the device one may infer the location, the height, the position and orientation of the front-end section of the drill string and calculate the orientation relative to the target position.

The device in one preferred embodiment may have a width substantially in a plane of the seat lying in the range of 5 cm to 50 cm. Transversely to this dimension, the device may have a length lying in the range of 10 cm to 60 cm (extension in the plane of the seat transversely to the aforementioned extension). Moreover, the device may have a dimension (height) substantially in a direction transversely to the two aforementioned lengths or extensions lying in the range of 10 cm to 20 cm. Preferably, the device comprises a plastic and/or a metal.

In one embodiment, the seat can be leveled by mechanical means such that the seat for the electronic unit can be oriented relative to the front-end section of the drill string so that the shortest line of connection of the midpoint of the front-end section of the drill string on which the device is mounted impinges on the surface of the seat at a substantially right angle. The optically viewed means of orienting the device may be designed as a spirit level, for example. In this way, manufacturing-related tolerances with regard to the device can be taken into account and/or an adjustment to different front-end sections is possible.

The term "drill string" in the sense of the specification encompasses rods, a chain, and/or a cable. The term "rods" encompasses in the sense of the specification not only rigid single rods having rod sections joined directly or indirectly to each other, but also in particular all force transmitting elements which may be used in a ground drilling device.

The term "front-end section of a drill string" denotes the section with the drilling head and any drill head tip which is present or a region adjacent to the drill head having the same orientation as the drill head. In an especially preferred embodiment, the "front-end section of a drill string" is the drill head or the drilling tool. In particular, the "front-end section of the drill string" may be a percussion drilling device or a displacement hammer.

In one preferred embodiment, the seat and the bearing surface are rigidly facing each other, so that a predetermined, well maintained relative position between the front-end section and the electronic unit can be formed. A fixed referencing is more easily possible. The calculation of the target position from the determination of the parameters of the electronic unit can be done merely by simple geometrical computation.

In one preferred embodiment, a magnet is provided on the bearing surface for interaction with the front-end section of the drill string, so that a simple mounting and positioning are made possible. No manually activated fastening means needs to be provided on the device.

In one preferred embodiment, the bearing surface lies against the front-end section with no additional fixation, where the term "with no additional fixation" encompasses a mounting means by which the device can be mounted on the front-end section. By means of the bearing surface, the device can be placed against the front-end section and be in stable equilibrium, possibly making use of adhesive and/or frictional forces. In this way, no structural elements for producing a fixation are needed and the device is more simple in its design and production.

In one preferred embodiment, the bearing surface may comprise two substantially flat contact surfaces making an angle with each other. By means of such a bearing, a simple positioning can be accomplished, not requiring any special and precise manipulation. A forced guidance can be achieved by means of the contact surfaces for the bearing of the device against the front-end section of the drill string. The device can be especially simple in construction and creates a reference for the mounting of the electronic unit relative to the front-end section of the drill string. The formation of two contact surfaces making an angle with each other, together with a determination of the position of the electronic device, is sufficient for determining the relative position between the front-end section and the electronic unit and calculating the orientation.

The invention also creates a system for orienting a front-end section of a drill string comprising the described device and the front-end section of the drill string. In this way, a system can be provided in which the device is adapted to the front-end section of the drill string. The use precisely for this front-end section can be made easier for the user.

The electronic unit is designed to determine at least one of the following pieces of information: location, height, position and direction. In this way, a system can be created which can be sufficient for the orienting of the front-end section of the drill string. A simple manipulation is possible. The device for the positioning of the electronic unit can simply be placed on the front-end section and the electronic unit inserted into or placed on the device. There is no need for an adjusting or a determining of the orientation of the drill string by the user with the aid of an optically sighted target. The electronic unit can show the user the momentary orientation of the drill string by means of the display on the electronic unit and/or indicate whether a desired orientation is present.

In one preferred embodiment, the electronic unit comprises a position sensor, a location sensor, a directional sensor and/or a height sensor. An optical distance sensor may also be configured at the electronic unit or be realized with it.

In the sense of the specification, the term "position sensor" encompasses a technical component by means of which a position of the electronic unit can be quantitatively detected. The position sensor may be designed as a gyroscope. The term "position" encompasses the angle which the electronic unit makes transversely to the longitudinal direction and transversely to the direction of the earth's acceleration.

In the sense of the specification, the term "location sensor" encompasses a technical component by means of which a location or a position of the electronic unit can be quantitatively detected. In particular, the location sensor may be a sensor for use within a position determination system, especially one which is satellite-based. The position determination system may be the GPS (Global Positioning System) or NAVSTAR GPS, the term "GPS" here being used as a generic designation or pars pro toto for all satellite navigation systems. The position determination system in particular may be the European global satellite navigation system Galileo, the American NACSTAR-GPS, the Russian GLONASS system and/or the Chinese BEIDOU system.

In the sense of the specification, the term "directional sensor" encompasses a technical component by means of which a direction of the electronic unit can be quantitatively detected. The directional sensor may be designed as a compass, determining the orientation of the housing of the electronic unit in relation to the directional sensor.

In the sense of the specification, the term "height sensor" encompasses a technical component by means of which a height of the electronic unit can be quantitatively ascertained. The term "height" encompasses in the sense of the specification the geographical height. One embodiment of a height sensor may be a barometer.

The invention also creates a method for orienting a front-end section, especially relative to a target position, especially in a target pit, of a drill string of a ground drilling device, wherein an electronic unit is positioned from the outside on the front-end section of the drill string, the electronic unit determines and displays at least one piece of information for the orienting, and the front-end section of the drill string is oriented by means of the information displayed by the electronic unit. The front-end section of the drill string may be arranged for this purpose on an orientation platform, having adjusting wheels and/or positioning elements by means of which the orientation of the drill string can be adjusted.

In one embodiment of a method for orienting a front-end section, especially to a target position, especially in target pit, of a drill string of a ground drilling device, an electronic unit is positioned relative to the front-end section of the drill string and the relative position between the electronic unit and the front-end section is ascertained. Furthermore, the position of the electronic unit, especially the absolute position in space, is determined, so that information can be calculated and displayed, and the front-end section of the drill string is oriented by means of the information displayed by the electronic unit. The front-end section of the drill string may be arranged for this purpose on an orientation platform, having adjusting wheels and/or positioning elements by means of which the orientation of the drill string can be adjusted.

It may be provided that a user performs the orienting by means of the displayed information. For this, for example, the positioning elements of the orientation platform will be operated by the user and the orientation platform will be adjusted accordingly. But it may also be provided in addition or alternatively that at least one positioning element has an actuator or motor, which can be actuated directly or indirectly by the electronic device, without the user performing an adjustment of the positioning element. In this way, at least one positioning element and preferably all positioning elements of the orientation platform can be automatically actuated to orient the front-end section of the drill string.

In one preferred embodiment, the electronic unit is used to display a position, a location, a direction and/or a height.

In one preferred embodiment, a further electronic unit or the same electronic unit that is used for the orienting in the form of a mobile telephone, a tablet or a smartphone determines the target position, for example by arranging the (further) electronic unit at the target position and determining the target position by means of a location determination of the (further) electronic unit.

It may also be provided that the target position in the form of data is entered into the electronic unit, such as can be found in the form of a (geographical) map or a representation showing topological information of the target pit/target position.

The invention also creates a use of an electronic unit for the orienting of a front-end section, especially relative to a target position, of a drill string, wherein the electronic unit is arranged on the front-end section of the drill string from the outside and the electronic unit is used to determine at least one of the following pieces of information before the drill string enters the soil: location, height, position and direction of the front-end section of the drill string.

The remarks on the individual aspects of the invention as are described in relation to the device, the system, the method and the use are to be understood as mutually supplementing remarks. Remarks about one aspect also hold for the remarks about one of the other aspects.

The preceding remarks, as well as the following description of exemplary embodiments, do not constitute any waiving of particular embodiments or features.

BRIEF DESCRIPTION OF THE DRAWINGS

The invention shall now be explained more closely with the aid of an exemplary embodiment represented in the figures.

The figures show:

FIG. 1 a front-end section of a drill string; and

FIG. 2 an exemplary optical display of an electronic unit for the orienting.

DETAILED DESCRIPTION

FIG. 1 shows a front-end section 1 of a drill string 2, which in the present exemplary embodiment is designed as a displacement hammer or percussion drilling device. In the housing of the displacement hammer, a striking piston moves back and forth, oscillating in known manner, and can drive the displacement hammer into the soil by pushing it. In FIG. 1, a drill head tip 3 is designed as a chisel.

The displacement hammer is situated on an orientation platform 4, by means of which the front-end section 1 of the drill string 2, mounted on it, can be oriented. Adjusting wheels 5 are present for support surfaces and/or support seats, by which the front-end section 1 of the drill string 2 can be changed in its direction, position and/or posture.

A device 6 lies against the front-end section 1 of the drill string 2, having a bearing surface 7 adapted to the outer contour of the front-end section 1. The bearing surface 7 has two contact surfaces, between which an angle is subtended amount substantially to 90 degrees.

At the side opposite the bearing surface 7, the device 6 has a seat 8, which is adapted to an electronic unit 9.

The device 6 creates a predetermined relation or relationship between the front-end section 1 of the drill string 2 and the electronic unit 9. By means of sensors of the electronic unit 9, the position and orientation of the electronic unit 9 in space can be detected in three dimensions, so that inferences are possible as to the orientation of the front-end section 1 of the drill string 2. If one knows the desired orientation of the front-end section 1 of the drill string 2, the predetermined arrangement of the electronic unit 9 relative to the front-end section 1 of the drill string 2 can be utilized for an orienting to a known target position.

On the electronic unit 9 there is installed a program which requests the entering of the target position to be achieved by the front-end section 1 of the drill string 2.

FIG. 2 shows schematically a display of an electronic unit 9 for the orienting. One area 10 shows an actual position, such as can be determined by the electronic unit 9. Moreover, an area 10 shows a target position 12 needed to reach the target. Furthermore, there is an area 11 in which the current inclination 13 is shown, as determined by the electronic unit 9, as compared to a target inclination 14 needed to reach the target. If the corresponding adjusting wheels 5 of the orientation platform 4 are activated, the actual values so determined can be adapted to the corresponding target values.

The invention claimed is:

1. A device for the positioning of an electronic unit on an outer contour of a front-end section of a drill string of a ground drilling device, wherein the electronic unit is designed to determine at least one of the following pieces of information: location, height, position and direction, and wherein the device has:

a seat for mounting or placement of the electronic unit onto the device; and a bearing surface adapted to be mounted to, or placed on, the outer contour of the front-end section, the bearing surface comprising two substantially flat contact surfaces for contacting the drill string which intersect to form a substantially right angle with each other.

2. The device according to claim 1, wherein the seat and the bearing surface are rigidly facing each other.

3. The device according to claim 1, wherein a magnet is provided on the bearing surface for interaction with the front-end section.

4. The device according to claim 1, wherein the bearing surface lies against the front-end section with no additional fixation.

5. The device of claim 1, wherein the electronic unit comprises a location sensor for use in a satellite-based position determination system.

6. A system for orienting a front-end section of a drill string comprising:

an electronic unit on an outer contour of a front-end section of a drill string of a ground drilling device, wherein the electronic unit is configured to ascertain and display at least one piece of information on the orienting, and the front-end section of the drill string is oriented by the at least one piece of information displayed by the electronic unit;

a device for the positioning of the electronic unit on an outer contour of the front-end section of the drill string of the ground drilling device comprising:

a seat for mounting or placement of the electronic unit onto the device; and a bearing surface adapted to be mounted to, or placed on, the outer contour of the front-end section, the bearing surface comprising two substantially flat contact surfaces for contacting the drill string which intersect to form an angle with each other;

wherein the electronic unit comprises an installed orienting application, the electronic unit being designed to determine at least one of the following pieces of information: location, height, position and direction, the electronic unit executing instructions of the installed orienting application to ascertain and display the at least one of the location, height, position, and direction;

wherein the orienting application is configured for receiving a target position for the front-end section of the drill string; and wherein the orienting application is further configured to generate an optical indication on the electronic unit for orienting the front-end section of the drill string to the target position.

7. The system of claim 6, wherein the substantially flat contact surfaces of the bearing surface for contacting the drill string are configured to intersect to form a substantially right angle with each other.

8. A method for orienting a front-end section of a drill string of a ground drilling device, comprising:

positioning a bearing surface of a positioning device for an electronic unit on an outer contour of the front-end section of the drill string from the outside, the bearing surface comprising two substantially flat contact surfaces for contacting the drill string which intersect to form an angle with each other;

installing, on the electronic unit, an orienting application;

executing instructions of the installed orienting application for ascertaining and displaying, by the electronic unit, at least one piece of information on the orienting, wherein the front-end section of the drill string is oriented based upon the at least one piece of information displayed by the electronic unit;

wherein the orienting application is configured for receiving a target position for the front-end section of the drill string; and wherein the relative position between the electronic unit and the front-end section ascertained and displayed by the electronic unit comprises an optical indication for orienting the front-end section of the drill string to the target position.

9. The method according to claim 8, wherein the electronic unit is used to display a position, a location, a direction and/or a height.

10. The method according to claim 8, wherein the electronic unit comprises a mobile telephone, a tablet or a smartphone, and wherein the electronic unit determines a target position to which the front-end section is oriented.

11. The method according to claim 8, wherein the position data of a target pit are entered as a target position to which the front-end section is oriented.

12. The method of claim 8, wherein the substantially flat contact surfaces of the bearing surface for contacting the drill string are configured to intersect to form a substantially right angle with each other.

13. The method of claim 8, wherein ascertaining and displaying, by the electronic unit, the relative position between the electronic unit and the front-end section comprises ascertaining and displaying, by the electronic unit comprising a location sensor for use in a satellite-based position determination system, the relative position between the electronic unit and the front-end section.

14. A method for orienting a front-end section of a drill string of a ground drilling device, comprising:

positioning a bearing surface of a positioning device for an electronic unit on an outer contour of the front-end section of the drill string, the bearing surface comprising two substantially flat contact surfaces for contacting the drill string which intersect to form a substantially right angle with each other; and ascertaining and displaying, by the electronic unit, a relative position between the electronic unit and the front-end section, wherein the front-end section of the drill string is oriented based upon the relative position information displayed by the electronic unit.

15. The method of claim 14, further comprising installing, on the electronic unit, an orienting application;

wherein the ascertain and displaying, by the electronic unit, the at least one piece of information on the orienting comprises executing instructions of the installed orienting application on the electronic unit for ascertaining and displaying, by the electronic unit, the at least one piece of information on the orienting.

16. The method of claim 15, wherein the orienting application is configured for receiving a target position for the front-end section of the drill string.

17. The method of claim 16, wherein the at least one piece of information on the orienting ascertained and displayed by the electronic unit comprises an optical indication for orienting the front-end section of the drill string to the target position.

* * * * *